US009533353B2

(12) United States Patent
Hanejko et al.

(10) Patent No.: US 9,533,353 B2
(45) Date of Patent: Jan. 3, 2017

(54) LUBRICANT SYSTEM FOR USE IN POWDER METALLURGY

(71) Applicant: Hoeganaes Corporation, Cinnaminson, NJ (US)

(72) Inventors: Francis G. Hanejko, Marlton, NJ (US); William Tambussi, Haddon Heights, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 777 days.

(21) Appl. No.: 13/773,705

(22) Filed: Feb. 22, 2013

(65) Prior Publication Data

US 2013/0224060 A1 Aug. 29, 2013

Related U.S. Application Data

(60) Provisional application No. 61/602,748, filed on Feb. 24, 2012.

(51) Int. Cl.
*B22F 1/00* (2006.01)
*C22C 33/02* (2006.01)

(52) U.S. Cl.
CPC ..... *B22F 1/0059* (2013.01); *B22F 1/007* (2013.01); *C22C 33/02* (2013.01); *B22F 1/0077* (2013.01); *B22F 2001/0066* (2013.01)

(58) Field of Classification Search
None
See application file for complete search history.

(56) References Cited

U.S. PATENT DOCUMENTS

| | | | | |
|---|---|---|---|---|
| 3,390,986 | A | 7/1968 | Stenerson | |
| 3,410,684 | A | 11/1968 | Printz | |
| 5,069,714 | A * | 12/1991 | Gosselin | B22F 1/0059 75/252 |
| 5,286,323 | A | 2/1994 | Bagley | |
| 5,308,556 | A | 5/1994 | Bagley | |
| 5,334,341 | A | 8/1994 | Streicher | |
| 5,432,223 | A | 7/1995 | Champagne | |
| 5,442,341 | A | 8/1995 | Lambropoulos | |

(Continued)

FOREIGN PATENT DOCUMENTS

| | | |
|---|---|---|
| CN | 101417337 | 4/2009 |
| CN | 101425412 | 5/2009 |

(Continued)

OTHER PUBLICATIONS

WO 2010105740 A1 machine translation.*

*Primary Examiner* — Keith Walker
*Assistant Examiner* — Stephani Hill
(74) *Attorney, Agent, or Firm* — Baker & Hostetler LLP

(57) ABSTRACT

The present invention is directed to metallurgical powder compositions having improved lubricant properties. These compositions of the invention include at least 90 wt. % of an iron-based metallurgical powder; a Group 1 or Group 2 metal stearate; a first wax having a melting range of between about 80 and 100° C.; a second wax having a melting range of between about 80 and 90° C.; zinc phosphate; boric acid; acetic acid; phosphoric acid; and a binder. Methods of compacting the compositions, as well as compacted articles prepared using those methods, are also described.

33 Claims, 1 Drawing Sheet

(56) References Cited

U.S. PATENT DOCUMENTS

| | | | | |
|---|---|---|---|---|
| 6,039,784 | A * | 3/2000 | Luk | B22F 1/0059 148/306 |
| 6,051,184 | A | 4/2000 | Kankawa | |
| 6,068,813 | A * | 5/2000 | Semel | C22C 33/0207 419/65 |
| 6,178,259 | B1 | 1/2001 | Harris | |
| 7,063,815 | B2 | 6/2006 | Li | |
| 7,524,352 | B2 | 4/2009 | Lindenau et al. | |
| 7,666,348 | B2 | 2/2010 | Ishijima et al. | |
| 2003/0084752 | A1 | 5/2003 | Anderson | |
| 2003/0193258 | A1 | 10/2003 | Reiter et al. | |
| 2003/0193260 | A1 | 10/2003 | Reiter et al. | |
| 2006/0018780 | A1 | 1/2006 | Hosamani et al. | |
| 2007/0186722 | A1 | 8/2007 | Hanejko | |
| 2008/0075619 | A1 | 3/2008 | Hosamani et al. | |
| 2008/0092383 | A1 | 4/2008 | Aust et al. | |
| 2011/0314964 | A1 | 12/2011 | Ishigami | |

FOREIGN PATENT DOCUMENTS

| | | | | |
|---|---|---|---|---|
| CN | 101670438 | | 3/2010 | |
| EP | 379583 | | 12/1998 | |
| EP | 1 205 949 | A2 | 5/2002 | |
| EP | 1119429 | | 7/2003 | |
| EP | 1536027 | | 8/2007 | |
| EP | 1722910 | | 11/2008 | |
| JP | 03800510 | | 7/2006 | |
| JP | 2007182593 | | 7/2007 | |
| JP | 04614028 | | 1/2011 | |
| KR | 962555 | | 6/2010 | |
| KR | 2009072596 | | 6/2010 | |
| KR | 1000702 | | 12/2010 | |
| WO | WO02/045889 | A2 | 6/2002 | |
| WO | WO 2010/041735 | | 4/2010 | |
| WO | WO 2010/081667 | | 7/2010 | |
| WO | WO 2010/106949 | | 9/2010 | |
| WO | WO 2010105740 | A1 * | 9/2010 | B22F 1/007 |
| WO | WO 2010/014009 | | 2/2012 | |

* cited by examiner

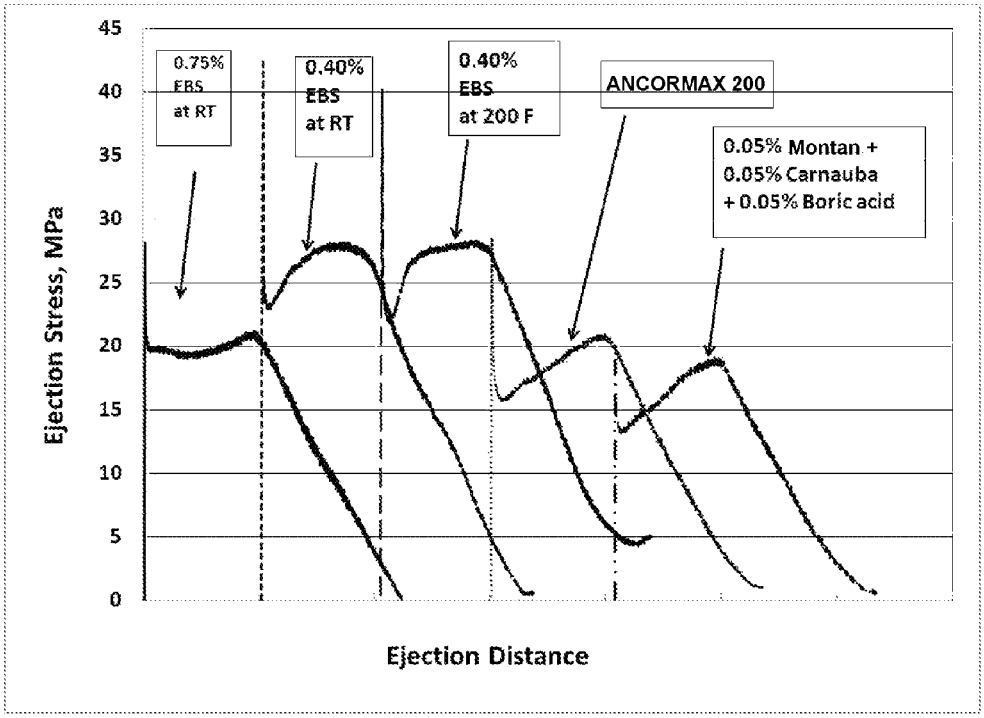
45
40
35
30
25
20
15
10
5
0
Ejection Stress, MPa
0.75% EBS at RT
0.40% EBS at RT
0.40% EBS at 200 F
ANCORMAX 200
0.05% Montan + 0.05% Carnauba + 0.05% Boric acid
Ejection Distance

LUBRICANT SYSTEM FOR USE IN POWDER METALLURGY

CROSS REFERENCE TO RELATED APPLICATIONS

This application claims the benefit of U.S. Provisional Application No. 61/602,748, filed Feb. 24, 2012, the entirety of which is incorporated by reference herein.

TECHNICAL FIELD

The present invention is related to metallurgical powder compositions that include an improved lubricant system. These metallurgical powder compositions can be used to form compacted parts.

BACKGROUND

Organic lubricants are commonly used in the powder metallurgical field to assist in the ejection of compacted metal parts from dies. But while lubricants are necessary, their use impairs the maximum achievable green density of a compacted part. As such, those in the art must sacrifice green and sintered density in order to sufficiently lubricate a compacted part so that it can be ejected from the die. Lubricants that maximize green density are still needed.

SUMMARY

The present invention is directed to metallurgical powder compositions comprising at least 90 wt. % of an iron-based metallurgical powder; a Group 1 or Group 2 metal stearate; a first wax having a melting range of between about 80 and 100° C.; a second wax having a melting range of between about 80 and 90° C.; zinc phosphate; boric acid; acetic acid; phosphoric acid; and polyvinylpyrrolidone. Methods of compacting such metallurgical powder compositions, as well as compacts prepared according to those methods, are also described.

BRIEF DESCRIPTION OF THE DRAWINGS

FIG. 1 depicts the strip slide data from one metallurgical powder composition of the invention, as compared to other metallurgical powder compositions

DETAILED DESCRIPTION OF ILLUSTRATIVE EMBODIMENTS

The present invention is directed to metallurgical powder compositions comprising an improved organic lubricant composition. Using the compositions of the invention provides for compacted parts having higher green densities as compared to those parts manufactured using another organic lubricant composition.

The invention is directed to metallurgical powder compositions comprising an iron-based powder. The metallurgical powder compositions of the invention preferably include at least 90 wt. % of an iron-based metallurgical powder.

Substantially pure iron powders are powders of iron containing not more than about 1.0% by weight, preferably no more than about 0.5% by weight, of normal impurities. Examples of such highly compressible, metallurgical-grade iron powders are the ANCORSTEEL® 1000 series of pure iron powders, e.g. 1000, 1000B, and 1000C, available from Hoeganaes Corporation, Riverton, N.J. For example, ANCORSTEEL® 1000 iron powder has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL® 1000 powder has an apparent density of from about 2.85-3.00 g/cm$^3$, typically 2.94 g/cm$^3$. Other substantially pure iron powders that can be used in the invention are typical sponge iron powders, such as Hoeganaes' ANCOR® MH-100 powder.

Exemplary prealloyed iron-based powders are stainless steel powders. These stainless steel powders that are commercially available in various grades in the Hoeganaes ANCOR® series, such as the ANCOR® 303L, 304L, 316L, 410L, 430L, 434L, and 409Cb powders. Also, iron-based powders include tool steels made by powder metallurgy methods.

Other exemplary iron-based powders are substantially pure iron powders prealloyed with alloying elements, such as for example molybdenum (Mo). Iron powders prealloyed with molybdenum are produced by atomizing a melt of substantially pure iron containing from about 0.5 to about 2.5 weight percent Mo. An example of such a powder is Hoeganaes' ANCORSTEEL® 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Other examples of molybdenum containing iron based powders are Hoeganaes' ANCORSTEEL® 737 powder (containing about 1.4 wt. % Ni—about 1.25 wt. % Mo—about 0.4 wt. % Mn; balance Fe), ANCORSTEEL® 2000 powder (containing about 0.46 wt. % Ni—about 0.61 wt. % Mo—about 0.25 wt. % Mn; balance Fe), ANCORSTEEL® 4300 powder (about 1.0 wt. % Cr—about 1.0 wt. % Ni—about 0.8 wt. % Mo—about 0.6 wt. % Si—about 0.1 wt. % Mn; balance Fe), and ANCORSTEEL® 4600V powder (about 1.83 wt. % Ni—about 0.56 wt. % Mo—about 0.15 wt. % Mn; balance Fe). Other exemplary iron-based powders are disclosed in U.S. application Ser. No. 10/818,782, which is herein incorporated by reference in its entirety.

An additional pre-alloyed iron-based powder is disclosed in U.S. Pat. No. 5,108,493, which is herein incorporated by reference in its entirety. These steel powder compositions are an admixture of two different pre-alloyed iron-based powders, one being a pre-alloy of iron with 0.5-2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL® 41 AB steel powder, which contains about 0.85 weight percent molybdenum, about 1 weight percent nickel, about 0.9 weight percent manganese, about 0.75 weight percent chromium, and about 0.5 weight percent carbon.

A further example of iron-based powders are diffusion-bonded iron-based powders which are particles of substantially pure iron that have a layer or coating of one or more other alloying elements or metals, such as steel-producing elements, diffused into their outer surfaces. A typical process for making such powders is to atomize a melt of iron and then combine this atomized annealed powder with the alloying powders and re-anneal this powder mixture in a furnace. Such commercially available powders include DISTALOY® 4600A diffusion bonded powder from Hoeganaes Corporation, which contains about 1.8% nickel, about 0.55% molybdenum, and about 1.6% copper, and DISTALOY® 4800A diffusion bonded powder from Hoeganaes Corporation, which contains about 4.05% nickel, about 0.55% molybdenum, and about 1.6% copper.

The particles of iron-based powders, such as the substantially pure iron, diffusion bonded iron, and pre-alloyed iron, have a distribution of particle sizes. Typically, these powders are such that at least about 90% by weight of the powder sample can pass through a No. 45 sieve (U.S. series), and more preferably at least about 90% by weight of the powder sample can pass through a No. 60 sieve. These powders typically have at least about 50% by weight of the powder passing through a No. 70 sieve and retained above or larger than a No. 400 sieve, more preferably at least about 50% by weight of the powder passing through a No. 70 sieve and retained above or larger than a No. 325 sieve. Also, these powders typically have at least about 5 weight percent, more commonly at least about 10 weight percent, and generally at least about 15 weight percent of the particles passing through a No. 325 sieve. Reference is made to MPIF Standard 05 for sieve analysis.

As such, metallurgical powder compositions can have a weight average particle size as small as one micron or below, or up to about 850-1,000 microns, but generally the particles will have a weight average particle size in the range of about 10-500 microns. Preferred are iron or pre-alloyed iron particles having a maximum weight average particle size up to about 350 microns; more preferably the particles will have a weight average particle size in the range of about 25-150 microns. In a preferred embodiment, metallurgical powder compositions have a typical particle size of less than 150 microns (−100 mesh), including, for example, powders having 38% to 48% of particles with a particle size of less than 45 microns (−325 mesh).

The described iron-based powders that constitute the base-metal powder, or at least a major amount thereof, are preferably water-atomized powders. These iron-based powders have apparent densities of at least 2.75, preferably between 2.75 and 4.6, more preferably between 2.8 and 4.0, and in some cases more preferably between 2.8 and 3.5 $g/cm^3$.

Corrosion resistant metallurgical powder compositions incorporate one or more alloying additives that enhance the mechanical or other properties of final compacted parts. Alloying additives are combined with the base iron powder by conventional powder metallurgy techniques known to those skilled in the art, such as for example, blending techniques, prealloying techniques, or diffusion bonding techniques. Preferably, alloy additives are combined with an iron-based powder by prealloying techniques, i.e., preparing a melt of iron and the desired alloying elements, and then atomizing the melt, whereby the atomized droplets form the powder upon solidification.

Alloying additives are those known in the powder metallurgical industry to enhance the corrosion resistance, strength, hardenability, or other desirable properties of compacted articles. Steel-producing elements are among the best known of these materials. Examples of alloying elements include, but are not limited to, chromium, graphite (carbon), molybdenum, copper, nickel, sulfur, phosphorus, silicon, manganese, titanium, aluminum, magnesium, gold, vanadium, columbium (niobium), or combinations thereof. Preferred alloying elements are steel producing alloys, such as for example, chromium, graphite, molybdenum, nickel, or combinations thereof. The amount of the alloying element or elements incorporated depends upon the properties desired in the final metal part. Pre-alloyed iron powders that incorporate such alloying elements are available from Hoeganaes Corp. as part of its ANCORSTEEL® line of powders.

The unique challenges presented by powder metallurgy techniques precludes direct analogy and correlation between wrought steel and powder metallurgy processes. For example, wrought steel compositions and processes do not provide the advantages associated with powder metallurgical compositions and process, which include, inter alia, production to near net shape, few or no required secondary operations, high material utilization, excellent homogeneity, availability of unique compositions and structures, and ability to form fine and isotropic metallurgical structures.

Metallurgical powders may include any concentration of carbon, sulfur, oxygen and nitrogen. For example, some embodiments may require high concentrations of carbon, and nitrogen to promote the formation of high temperature martensite. Nitrogen concentrations, in particular, stabilize the martensite phase of a dual phase microstructure. But, carbon, sulfur, oxygen, and nitrogen additives are preferably kept as low as possible in order to improve compressibility and sinterability. Preferably, metallurgical powder compositions contain, independently, from about 0.001 to about 0.1 weight percent carbon, about 0.0 to about 0.1 weight percent sulfur, about 0.0 to about 0.3 weight percent oxygen, and about 0.0 to about 0.1 weight percent nitrogen. More preferably, metallurgical powder compositions contain, independently, from about 0.001 to about 0.1 weight percent carbon, about 0.0 to about 0.1 weight percent sulfur, about 0.0 to about 0.1 weight percent oxygen, about 0.0 to about 0.1 weight percent nitrogen.

Similarly, metallurgical powders may include silicon additions in any concentration. However, high silicon concentrations, for example greater than about 0.85 weight percent, are utilized to produce a powder that is low in oxygen. Typically, the silicon level in a melt is increased prior to atomization. Silicon additions add strength to compacted parts, and also stabilize the ferrite phase of the dual phase microstructure. Preferably, metallurgical powder compositions contain up to about 1.5 weight percent silicon. More preferably, metallurgical powder compositions contain from about 0.1 to about 1.5 weight percent silicon, and even more preferably from about 0.85 to about 1.5 weight percent silicon.

Metallurgical powders may contain chromium in any concentration. Chromium additions stabilize the ferritic phase of the dual phase microstructure and impart corrosion resistance. Generally, chromium additions also impart strength, hardenability, and wear resistance. Preferably, metallurgical powder compositions contain from about 5.0 to about 30.0 weight percent chromium. More preferably, metallurgical powder compositions contain from about 10 to about 30.0 weight percent chromium, and even more preferably from about 10 to about 20 weight percent chromium.

Metallurgical powders may contain nickel in any concentration. Nickel is generally used to promote the formation of high temperature martensite. In addition, nickel improves toughness, impact resistance and corrosion resistance. Although nickel additions may reduce compressibility at high concentrations, nickel may be used at moderate levels without dramatically decreasing compressibility. Preferably, metallurgical resistant powder compositions contain from about 0.1 to about 1.5 weight percent nickel, and even more preferably from about 1.0 to about 1.5 weight percent nickel.

Metallurgical powders may contain manganese in any concentration. Manganese additions increase the work hardening capacity of compacted parts and promote the formation of high temperature martensite. However, manganese concentration is generally kept at low levels because it contributes to the formation of porous oxides on the surface of powders. This porous oxide increases oxygen concentrations on the powder surface, which impedes sintering. Typically, manganese additions also decrease the compressibility of powders. Preferably, metallurgical powder compositions contain up to about 0.5 weight percent manganese. More preferably, metallurgical powder compositions contain from about 0.01 to about 0.5 weight percent manganese, and even more preferably from about 0.1 to about 0.25 weight percent manganese.

Metallurgical powders may contain copper in any concentration. Copper additions increase corrosion resistance, while also providing solid solution strengthening. Although copper additions may reduce compressibility at high concentrations, copper may be used at moderate levels without dramatically decreasing compressibility. Copper additions also promote the formation of high temperature martensite. Preferably, corrosion resistant metallurgical powder compositions contain from about 0.01 to about 1.0 weight percent copper. More preferably, metallurgical powder compositions contain from about 0.1 to about 0.8 weight percent copper, and even more preferably from about 0.25 to about 0.75 weight percent copper.

Metallurgical powders may contain molybdenum in any concentration. Molybdenum additives increase hardenability, high temperature strength, and impact toughness while contributing to high-temperature oxidation resistance. Molybdenum also contributes to the stabilization of the ferritic phase of the dual phase microstructure of compacted parts. Preferably, metallurgical powder compositions contain from about 0.01 to about 1.0 weight percent molybdenum. More preferably, metallurgical powder compositions contain from about 0.1 to about 1.0 weight percent molybdenum, preferably from about 0.5 to about 1.0 weight percent molybdenum, and even more preferably from about 0.85 to about 1.0 weight percent molybdenum.

Metallurgical powders may contain titanium and aluminum in any concentration. Titanium and aluminum additives, individually, stabilize the ferrite phase of the dual phase microstructure. Preferably, metallurgical powder compositions contain up to about 0.2 weight percent titanium and, independently, up to about 0.1 weight percent aluminum.

Metallurgical powders may contain phosphorus in any concentration. Phosphorus additives promote the formation of high temperature martensite. Preferably, corrosion resistant metallurgical powder compositions contain up to about 0.1 weight percent phosphorus.

Alloy additives are selected to form an alloy system that provides desired properties. The selection of individual alloy elements and the amounts thereof should be chosen so as not to pose a significant detriment to the physical properties of the composition. For example, elements such as nickel, molybdenum, and copper may be added in relatively small proportions to increase green density.

Metallurgical powders, such as for example, stainless steels can be classified in a variety of ways. The key differences in properties, however, are determined by the type of alloy matrix created after processing. Alloys systems are based predominantly around ferritic, austenitic, and martensitic alloy matrices.

The metallurgical powder compositions of the invention further include a Group 1 metal stearate, Group 2 metal stearate, or ethylene bisstearamide. "Group 1" metals are those metals falling within Group 1 of the periodic table and include, for example, lithium, sodium, potassium, and cesium. "Group 2" metals are those metals falling within Group 2 of the periodic table and include, for example, magnesium, calcium, strontium, and barium.

Preferably, the Group 1 metal stearate, Group 2 metal stearate, or ethylene bisstearamide is present at about 0.05 wt. % to about 1.5 wt. % of the metallurgical powder composition. In preferred embodiments, the Group 1 metal stearate, Group 2 metal stearate, or ethylene bisstearamide is present at about 0.08 wt. % to about 1.2 wt. % of the metallurgical powder composition. In more preferred embodiments, the Group 1 metal stearate, Group 2 metal stearate, or ethylene bisstearamide is present at about 0.09 wt. % to about 1.1 wt. % of the metallurgical powder composition. Most preferably, the Group 1 metal stearate, Group 2 metal stearate, or ethylene bisstearamide is present at about 0.1 wt. % of the metallurgical powder composition. Exemplary Group 1 or Group 2 metal stearates include lithium stearate and calcium stearate. A preferred ethylene bisstearamide is ACRAWAX® (Lonza Inc., Allendale, N.J.).

The metallurgical powder compositions of the invention also include a first wax having a melting range of between about 80 and 100° C. Preferably, the metallurgical powder compositions of the invention include about 0.03 wt. % to about 0.1 wt. % of the first wax. In other embodiments, the metallurgical powder compositions of the invention include about 0.03 wt. % to about 0.07 wt. % of the first wax. More preferably, the metallurgical powder compositions of the invention include about 0.05 wt. % of the first wax. An exemplary first wax is Montan wax.

The metallurgical powder compositions of the invention further include a second wax, which is different from the first wax, having a melting range of between about 80 and 90° C. Preferably, the metallurgical powder compositions of the invention include about 0.03 wt. % to about 0.1 wt. % of the second wax. In other embodiments, the metallurgical powder compositions of the invention include about 0.03 wt. % to about 0.07 wt. % of the second wax. More preferably, the metallurgical powder compositions of the invention include about 0.05 wt. % of the second wax. An exemplary second wax is carnauba wax.

The metallurgical powder compositions of the invention further include zinc phosphate, boric acid, acetic acid, phosphoric acid, and a binder.

Preferably, metallurgical powder compositions of the invention include about 0.03 wt. % to about 0.1 wt. % of zinc phosphate. More preferably, metallurgical powder compositions of the invention include about 0.03 wt. % to about 0.07 wt. % of zinc phosphate. Even more preferably, metallurgical powder compositions of the invention include about 0.05 wt. % of zinc phosphate.

Preferably, metallurgical powder compositions of the invention include about 0.03 wt. % to about 0.1 wt. % of boric acid. More preferably, metallurgical powder compositions of the invention include about 0.03 wt. % to about 0.07 wt. % of boric acid. Even more preferably, metallurgical powder compositions of the invention include about 0.05 wt. % of boric acid.

Preferably, metallurgical powder compositions of the invention include about 0.03 wt. % to about 0.1 wt. % of acetic acid. More preferably, metallurgical powder compositions of the invention include about 0.03 wt. % to about 0.07 wt. % of acetic acid. Even more preferably, metallurgical powder compositions of the invention include about 0.05 wt. % of acetic acid.

Preferably, metallurgical powder compositions of the invention include about 0.03 wt. % to about 0.1 wt. % of phosphoric acid. More preferably, metallurgical powder compositions of the invention include about 0.03 wt. % to about 0.07 wt. % of phosphoric acid. Even more preferably, metallurgical powder compositions of the invention include about 0.05 wt. % of phosphoric acid.

Other acids, for example, citric acid, can also be added. Preferably, these other acids are present at about 0.05 wt. %, based on the weight of the metallurgical powder composition.

Preferably, metallurgical powder compositions of the invention include about 0.03 wt. % to about 0.1 wt. % of a binder. Binders used in the invention are those that minimize segregation during powder handling. Preferred examples of such binders are polyvinyl alcohol, cellulose ester, and polyvinylpyrrolidone. Cellulose esters include, for example, those that are soluble in organic solvents, for example acetone, with film forming characteristics and appropriate thermal decompositions properties during sintering. Such cellulose esters are those typically used in the production of photographic films, such as those available from Eastman Kodak. More preferably, metallurgical powder compositions of the invention include about 0.03 wt. % to about 0.07 wt. % of the binder. Even more preferably, metallurgical powder compositions of the invention include about 0.05 wt. % of the binder.

A particularly preferred metallurgical powder composition of the invention comprises, in addition to at least 90 wt. % of an iron-based metallurgical powder, about 0.1 wt. % of the Group 1 metal stearate, Group 2 metal stearate, or ethylene bisstearamide, preferably lithium stearate or ethylene bisstearamide; about 0.05 wt. % of the first wax, preferably Montan wax; about 0.05 wt. % of the second wax, preferably carnauba wax; about 0.05 wt. % of the zinc phosphate; about 0.03 wt. % to about 0.1 wt. % of boric acid; about 0.03 wt. % to about 0.1 wt. % of acetic acid; about 0.03 wt. % to about 0.1 wt. % of phosphoric acid; and about 0.03 wt. % to about 0.1 wt. % of polyvinyl alcohol, cellulose ester, or polyvinylpyrrolidone.

Within the scope of the invention, the components of the metallurgical powder compositions can be added together, combined, and/or bonded in any order. For example, the first and second waxes can be bonded to the metallurgical powder compositions or can be added after the initial bonding of the metallurgical powder compositions.

The metallurgical powder compositions of the invention may be formed into a variety of product shapes known to those skilled in the art, such as for example, the formation of billets, bars, rods, wire, strips, plates, or sheet using conventional practices.

Compacted articles prepared using the described metallurgical powder compositions are prepared by compacting the described metallurgical powder compositions using conventional techniques known to those skilled in the art. Generally, the metallurgical powder compositions are compacted at more than about 5 tons per square inch (tsi). Preferably, the metallurgical powder compositions are compacted at from about 5 to about 200 tsi, and more preferably, from about 30 to about 60 tsi. The resulting green compact can be sintered. Preferably, a sintering temperature of at least 2000° F., preferably at least about 2200° F. (1200° C.), more preferably at least about 2250° F. (1230° C.), and even more preferably at least about 2300° F. (1260° C.), is used. The sintering operation can also be conducted at lower temperatures, such as at least 2100° F.

Sintered parts typically have a density of at least about 6.6 g/cm$^3$, preferably at least about 6.68 g/cm$^3$, more preferably at least about 7.0 g/cm$^3$, more preferably from about 7.15 g/cm$^3$ to about 7.38 g/cm$^3$. Still more preferably, sintered parts have a density of at least about 7.4 g/cm$^3$. Densities of 7.50 g/cm$^3$ are also achieved using the metallurgical powder compositions of the invention.

Those skilled in the art will appreciate that numerous changes and modifications may be made to the preferred embodiments of the invention and that such changes and modifications may be made without departing from the spirit of the invention. The following examples further describe the metallurgical powder compositions.

EXAMPLES

Example 1

Preparation of a Metallurgical Powder Composition

ANCORSTEEL® iron powder (Hoeganaes Corp., Cinnaminson, N.J.) was blended with zinc phosphate (0.05 wt. %), boric acid powder (0.05 wt. %), acetic acid (0.05 wt. %), phosphoric acid (0.05 wt. %), and polyvinyl alcohol ("PVAC"), cellulose ester, or polyvinylpyrrolidone (0.05 wt. %, dissolved in acetone). The acetone was removed via vacuum evacuation to form a bonded powder mass. Montan wax (0.05 wt. %), carnauba wax (0.05 wt. %), lithium stearate (0.10 wt. %) and iron oxide ($Fe_3O_4$, 0.03 wt. %) was blended into the bonded powder mass to form a metallurgical powder composition of the invention.

Example 2

Compaction of a Metallurgical Powder Composition

The metallurgical powder composition of Example 1 was compacted at 60 tsi at a die temperature of 120° C. The resulting compact had a density of 7.50 g/cm$^3$.

Example 3

Ejection Characteristics

The ejection characteristics were tested of a compacted article prepared from a metallurgical powder composition of the invention comprising 0.1 wt. % lithium stearate, 0.05 wt. % Montan wax, 0.05 wt. % carnauba wax, 0.05 wt. % zinc phosphate, 0.05 wt. % boric acid, 0.05 wt. % acetic acid, 0.05 wt. % phosphoric acid, 0.05 wt. % polyvinylpyrrolidone, and the remainder being ANCORSTEEL®. Three compaction temperatures were tested for these compositions: 200° F., 225° F., and 250° F. A composition comprising ANCORSTEEL® and ANCORMAX® 200 lubricant (Hoeganaes Corp., Cinnaminson, N.J.) was also tested for comparison. The strip slide results are depicted in FIG. 1.

In FIG. 1, five compositions using different lubricant compositions were tested. Each composition included ANCORSTEEL® 1000B with 2% elemental nickel and 0.50% graphite with the lubricants as follows: (1) a composition including 0.75% ethylene bisstearamide at room temperature; (2) a composition including 0.40% ethylene bisstearamide at room temperature; (3) a composition including 0.40% ethylene bisstearamide at 200° F.; (4) a composition including ANCORMAX 200™ (0.40% of total lubricant) at 200° F.; (5) a composition of the present invention (0.05% Montan wax, 0.05% carnauba wax, 0.05% boric acid, 0.05% zinc phosphate 0.10% lithium stearate, 0.05% polyvinylpyrrolidone, 0.05% phosphoric acid, 0.05% citric acid) including 0.25% total lubricant at 225° F.

Compositions were compacted to a 0.55 inch×1.0 inch sample at 55 tsi (750 MPa) prior to testing.

In FIG. 1, the initial peak is the stripping force required to initiate ejection, the lower plateau is the sliding force or the force required to sustain movement of the compacted part to complete ejection. The maximum spike, i.e., the stripping pressure or the pressure necessary to overcome static friction, is lowest for the composition of the present invention. Additionally, the balance of the curve of FIG. 1 is the sliding pressure, i.e., the force required to eject the compacted part from the die, is lowest for the composition of the present invention. The maximum ejection distance for each composition was kept essentially the same (about 45 mm) so that the curves could be matched directly for comparison.

The results shown in FIG. 1 indicate that the peak stripping force for the composition of the invention is lower than that using ANCORMAX® 200 lubricant or standard premixes using ACRAWAX®. This trend applies for the three compaction temperatures tested. The sliding pressure at either 200° F. or 225° F. is lower for the composition of the invention as compared to the composition using ANCORMAX® 200 lubricant. The compacted density for the metallurgical powder composition of the invention is higher for all temperatures. At 250° F., the sliding pressure is only about 10% higher than for the ANCORMAX® 200 lubricant but the density is increased from 7.40 g/cm$^3$ to 7.50 g/cm$^3$. The surface finish for the ejected components is the same under all four conditions tested.

Example 4

Comparative Examples

| Bonding | Premix | Compaction | | Die Temp | Density | Strip | Slide |
|---|---|---|---|---|---|---|---|
| Technique | Composition | TSI | Mpa | ° F. | g/cm$^3$ | psi | psi |
| ANCORMAX ® 200, K17 binder, acetic acid, boric acid, phosphoric acid, Montan wax, carnauba wax with 0.25% total organic added | ANCORSTEEL ® 1000B with 2% nickel and 0.50% graphite with lithium stearate | 40 | 552 | 225 | 7.24 | 2652 | 2079 |
| | | 50 | 689 | 225 | 7.40 | 3037 | 2889 |
| | | 60 | 827 | 225 | 7.50 | 3178 | 2721 |
| ANCORMAX ® 200 with 0.40% total organic content | ANCORSTEEL ® 1000B with 2% nickel and 0.50% graphite | 55 | 758 | 200 | 7.35 | 4140 | 3050 |
| Standard premix of composition with 0.75 wt. % ACRAWAX ®, std premixing | ANCORSTEEL ® 1000B with 2% nickel and 0.50% graphite | 55 | 758 | Room | 7.22 | 4107 | 3064 |
| Standard premix of composition with 0.45 wt. % ACRAWAX ®, std premixing | ANCORSTEEL ® 1000B with 2% nickel and 0.50% graphite | 55 | 758 | Room | 7.29 | 6080 | 4069 |
| | | 55 | 758 | 200 | 7.41 | 5833 | 4104 |
| ANCORMAX ® 200, PVAC binder, acetic acid, boric acid, phosphoric acid, Montan wax, carnauba wax with 0.25% total organic added | ANCORSTEEL ® 1000B with 2% nickel and 0.50% graphite with lithium stearate | 60 | 827 | 225 | 7.49 | 3436 | 2530 |
| ANCORMAX ® 200, cellulose ester binder, acetic acid, boric acid, phosphoric acid, Montan wax, carnauba wax with 0.25% total organic added | ANCORSTEEL ® 1000B with 2% nickel and 0.50% graphite with lithium stearate | 60 | 827 | 225 | 7.45 | 3759 | 2602 |
| ANCORMAX ® 200, K17 binder, acetic acid, boric acid, phosphoric acid, Montan wax, carnauba wax with 0.25% total organic added | ANCORSTEEL ® 1000B with 2% nickel and 0.50% graphite with ACRAWAX ® | 60 | 225 | 225 | 7.47 | 2750 | 2700 |

REFERENCES

US Published Application No. 2003/0084752
US Published Application No. 2003/0193258
US Published Application No. 2003/0193260
US Published Application No. 2006/0018780
US Published Application No. 2008/0092383
US Published Application No. 2008/0075619
U.S. Pat. No. 7,063,815
U.S. Pat. No. 7,666,348
U.S. Pat. No. 7,524,352
U.S. Pat. No. 6,187,259
U.S. Pat. No. 6,051,184
U.S. Pat. No. 5,334,341
U.S. Pat. No. 5,432,223
U.S. Pat. No. 5,069,714
U.S. Pat. No. 5,442,341
U.S. Pat. No. 5,308,556
U.S. Pat. No. 5,286,323
U.S. Pat. No. 3,410,684
U.S. Pat. No. 3,390,986
WO2010/106949
WO2010/081667
WO2010/041735
WO2010/014009
EP1119429
EP1722910
EP1536027
EP379583
JP2007182593
JP2005381347
JP03800510
JP04614028
KR2009072596
KR1000702
KR962555
CN101670438
CN101425412
CN101417337

What is claimed:

1. A metallurgical powder composition comprising:

at least 90 wt. % of an iron-based metallurgical powder;

a Group 1 metal stearate, a Group 2 metal stearate, or ethylene bisstearamide;

a first wax having a melting range of between about 80 and 100° C.;

about 0.03 wt. % to about 0.1 wt. % of a second wax having a melting range of between about 80 and 90° C.;

zinc phosphate;

boric acid;

acetic acid;

phosphoric acid; and a binder.

2. The metallurgical powder composition of claim 1 comprising:

about 0.05 wt. % to about 1.5 wt. % of the Group 1 metal stearate, Group 2 metal stearate, or ethylene bisstearamide;

about 0.03 wt. % to about 0.1 wt. % of a first wax having a melting range of between about 80 and 100° C.;

about 0.03 wt. % to about 0.1 wt. % of a second wax having a melting range of between about 80 and 90° C.;

about 0.03 wt. % to about 0.1 wt. % of zinc phosphate;

about 0.03 wt. % to about 0.1 wt. % of boric acid;

about 0.03 wt. % to about 0.1 wt. % of acetic acid;

about 0.03 wt. % to about 0.1 wt. % of phosphoric acid; and about 0.03 wt. % to about 0.1 wt. % of the binder.

3. The metallurgical powder composition of claim 1, wherein the first wax is Montan wax.

4. The metallurgical powder composition of claim 1, wherein the second wax is carnauba wax.

5. The metallurgical powder composition of claim 1, comprising about 0.08 wt. % to about 1.2 wt. % of the Group 1 metal stearate, Group 2 metal stearate, or ethylene bisstearamide.

6. The metallurgical powder composition of claim 1, comprising about 0.09 wt. % to about 1.1 wt. % of the Group 1 metal stearate, Group 2 metal stearate, or ethylene bisstearamide.

7. The metallurgical powder composition of claim 1 comprising ethylene bisstearamide.

8. The metallurgical powder composition of claim 1, wherein the Group 1 metal stearate or Group 2 metal stearate is lithium stearate.

9. The metallurgical powder composition of claim 1, comprising about 0.03 wt. % to about 0.07 wt. % of the first wax.

10. The metallurgical powder composition of claim 1, comprising about 0.05 wt. % of the first wax.

11. The metallurgical powder composition of claim 1, comprising about 0.03 wt. % to about 0.07 wt. % of the second wax.

12. The metallurgical powder composition of claim 1, comprising about 0.05 wt. % of the second wax.

13. The metallurgical powder composition of claim 1, comprising about 0.03 wt. % to about 0.07 wt. % of the zinc phosphate.

14. The metallurgical powder composition of claim 1, comprising about 0.05 wt. % of the zinc phosphate.

15. The metallurgical powder composition of claim 1, comprising about 0.03 wt. % to about 0.07 wt. % of the boric acid.

16. The metallurgical powder composition of claim 1, comprising about 0.05 wt. % of the boric acid.

17. The metallurgical powder composition of claim 1, comprising about 0.03 wt. % to about 0.07 wt. % of the acetic acid.

18. The metallurgical powder composition of claim 1, comprising about 0.05 wt. % of the acetic acid.

19. The metallurgical powder composition of claim 1, comprising about 0.03 wt. % to about 0.07 wt. % of the phosphoric acid.

20. The metallurgical powder composition of claim 1, comprising about 0.05 wt. % of the phosphoric acid.

21. The metallurgical powder composition of claim 1, comprising about 0.03 wt. % to about 0.07 wt. % of the binder.

22. The metallurgical powder composition of claim 1, comprising about 0.05 wt. % of the binder.

23. The metallurgical powder composition of claim 1 wherein the binder is polyvinyl alcohol, cellulose ester, polyvinylpyrrolidone, or a combination thereof.

24. The metallurgical powder composition of claim 1 wherein the binder is polyvinyl alcohol.

25. The metallurgical powder composition of claim 1 wherein the binder is cellulose ester.

26. The metallurgical powder composition of claim 1 wherein the binder is polyvinylpyrrolidone.

27. The metallurgical powder composition of claim 1, comprising:

about 0.1 wt. % of the Group 1 metal stearate, Group 2 metal stearate, or ethylene bisstearamide;

about 0.05 wt. % of the first wax;

about 0.05 wt. % of the second wax;
about 0.05 wt. % of zinc phosphate;
about 0.03 wt. % to about 0.1 wt. % of boric acid;
about 0.03 wt. % to about 0.1 wt. % of acetic acid;
about 0.03 wt. % to about 0.1 wt. % of phosphoric acid; and
about 0.03 wt. % to about 0.1 wt. % of the binder.

28. The metallurgical powder composition of claim 27, wherein the Group 1 metal stearate or Group 2 metal stearate is lithium stearate.

29. The metallurgical powder composition of claim 27 comprising ethylene bisstearamide.

30. The metallurgical powder composition of claim 27, wherein the first wax is Montan wax.

31. The metallurgical powder composition of claim 27, wherein the second wax is carnauba wax.

32. The metallurgical powder composition of claim 27, wherein the binder is polyvinyl alcohol, cellulose ester, polyvinylpyrrolidone, or a combination thereof.

33. A method of making a metal part comprising compacting the metallurgical powder composition of claim 1.

* * * * *